United States Patent [19]

Knott

[11] 4,123,871

[45] Nov. 7, 1978

[54] TOY TEA KETTLE

[76] Inventor: Philip H. Knott, One San Antonio Pl., San Francisco, Calif. 94133

[21] Appl. No.: 783,981

[22] Filed: Apr. 4, 1977

[51] Int. Cl.[2] ..... A63H 33/30

[52] U.S. Cl. ..... 46/14; 46/41

[58] Field of Search ..... 46/14, 41, 44

[56] References Cited

U.S. PATENT DOCUMENTS

| | | | |
|---|---|---|---|
| 2,996,831 | 8/1961 | Woron | 46/41 |
| 3,046,683 | 7/1962 | Buh et al. | 46/14 |
| 3,061,970 | 11/1962 | Knott | 46/14 |
| 3,078,607 | 2/1963 | Butler et al. | 46/14 |
| 3,205,610 | 9/1965 | Palumbo et al. | 46/14 |

*Primary Examiner*—Louis G. Mancene
*Assistant Examiner*—Robert F. Cutting
*Attorney, Agent, or Firm*—Limbach, Limbach & Sutton

[57] ABSTRACT

An amusement device in the form of a tea kettle simulates, without heat, the boiling of water within the device and the sound of steam escaping therefrom, the device including a primary reservoir initially filled with a liquid, a lower reservoir from which air bubbles through the liquid in the primary reservoir to simulate boiling, and means providing for the rapid introduction of air into the device to produce a sound simulating the sound of escaping steam.

21 Claims, 9 Drawing Figures

TOY TEA KETTLE

BACKGROUND OF THE INVENTION

This invention relates generally to a display device or toy and more particularly to one simulating a tea kettle having water boiling within.

Toys which simulate the action of actual devices used by adults have long been popular with children over a wide range of ages. Among the most popular of such toys have been those which simulate the function of common household items, such as are used by adult homemakers in everyday life. A particularly popular group of such toys have been those which simulate items commonly used in the kitchen, such as sinks, stoves, cooking utensils, and the like. Many of these items can be used in a manner which essentially duplicates the function of the real item without the requirement of any simulation of that function. However, significant safety problems are posed by any toys or devices which involve the utilization of heat. Thus, it is necessary to simulate the effects of the application of heat with such toys instead of utilizing merely the duplication of function and the application of actual heat thereto.

One of the most difficult functions to simulate has been that of boiling water, such as is used in tea kettles and coffee pots. However, the desirability of having toys of this nature has led to numerous approaches and methods of simulation. For example, the action of a coffee percolator has been simulated in toys disclosed in Butler et al, U.S. Pat. No. 3,078,607, Buh, Jr. et al, U.S. Pat. No. 3,046,683, Pearson, Jr., U.S. Pat. No. 2,991,575, and in U.S. Pat. No. 3,061,970, owned by the present inventor. The difficulty in simulating the action of boiling water is reflected in the use in the Butler et al, Buh, Jr. et al and Pearson, Jr. patents of battery operated, motor-driven devices, which have the inherent problems of both complexity, and thus expense, and also the short lifetime of the operating batteries. A different approach to simulating action of boiling water in a tea kettle was disclosed in Palumbo et al, U.S. Pat. No. 3,205,610 in which a concealed balloon is pumped up by a bellows assembly and is then vented through a tube which extends through a toy tea kettle and has a whistle on the end for simulating the whistling of steam escaping from a boiling tea kettle. However, the realism of such a tea kettle is severely compromised by the unnatural requirement for using a bellows device to pump up the balloon. Realism of this Palumbo et al device is further compromised by the immediate initiation of the whistling sound upon setting the toy tea kettle upon its stove-simulating stand, unlike the real object which requires a period of time of boiling to generate sufficient steam to initiate the whistling. This structure, like the coffee percolators, also suffers from the disadvantage of complexity and thus potential for damage through the rough use frequently given toys.

SUMMARY OF THE INVENTION

In view of the foregoing desirable features of a toy tea kettle and the limitations of the prior art, it is an object of this invention to provide an amusement device in the form of a toy tea kettle which simulates, without heat, the boiling of water within the kettle and the sound of the escape of steam therefrom. It is an additional object of this invention to provide such a toy tea kettle in which the boiling of water and the escape of stream may be simulated without the requirement of external mechanical or electrical means. It is yet another object of this invention to provide such a toy tea kettle in which the simulated boiling and steam-escaping action is obtained solely by filling the toy tea kettle with a suitable liquid, such as water, and setting the tea kettle upright.

To achieve the foregoing plus additional objects, an amusement device in the form of a toy tea kettle for simulating the boiling of water therewithin and the sound of the escape of steam therefrom is disclosed. This device comprises a body having a primary reservoir, a lower reservoir disposed generally below the primary reservoir when the device is in a generally upright orientation, a filling aperture through which liquid is introduced into the primary reservoir, liquid flow control and venting means joining the primary and lower reservoirs, and sound producing means. The liquid flow control and venting means provide for the controlled flow of liquid and air between the primary and lower reservoirs and provide for maintaining air within the lower reservoir while liquid is being introduced into the primary reservoir. The sound producing means includes an upper reservoir, means for introducing into the upper reservoir a portion of the liquid introduced in the primary reservoir when the device is being filled with the filling aperture facing upward, and liquid holding means for holding the upper reservoir liquid within the upper reservoir when the device is reoriented from the filling orientation to a generally upright position. The upper reservoir is spaced above the lowermost portion of the primary reservoir and communicates with the primary reservoir. The liquid holding means holds the upper reservoir liquid portion within the upper reservoir in the upright position as long as the liquid level within the primary reservoir is maintained at not less than a predetermined level and then, when a sufficient quantity of liquid has flowed from the primary reservoir into the lower reservoir to lower the primary reservoir liquid level below the predetermined level, the liquid holding means provides for both the rapid flow of liquid from the upper reservoir into the primary reservoir and for the rapid introduction of air into the upper reservoir to replace the liquid flowing therefrom and to produce the sound simulating the sound of steam escaping from a tea kettle.

According to a preferred embodiment of this invention at least a portion of the sides of the primary reservoir is made of a transparent material so that the air bubbling through the liquid in the primary reservoir to simulate the boiling may be observed by a user.

DESCRIPTION OF A PREFERRED EMBODIMENT

Figure 5:
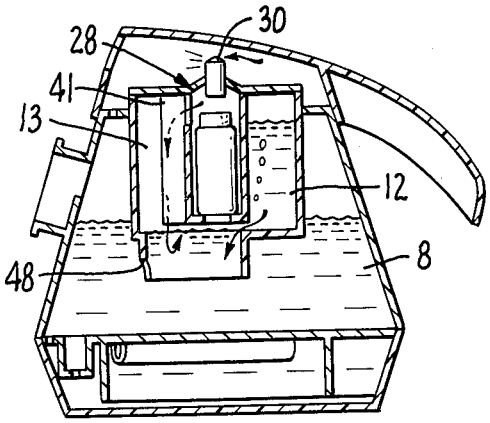
FIG. 5 is a side sectional view of the device of FIG. 1 during the release of water from the upper reservoir.
Figure 6:
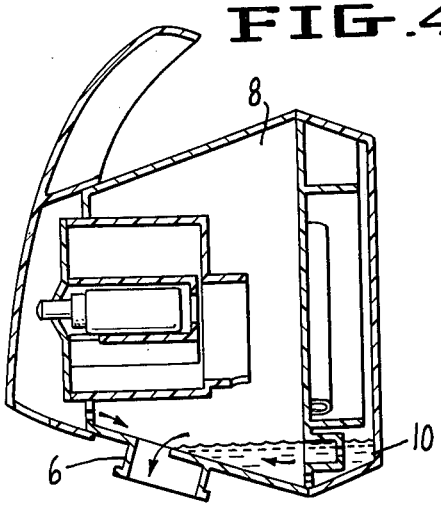
FIG. 6 is a side sectional view of the device of FIG. 1 oriented in its emptying position.
Figure 7:
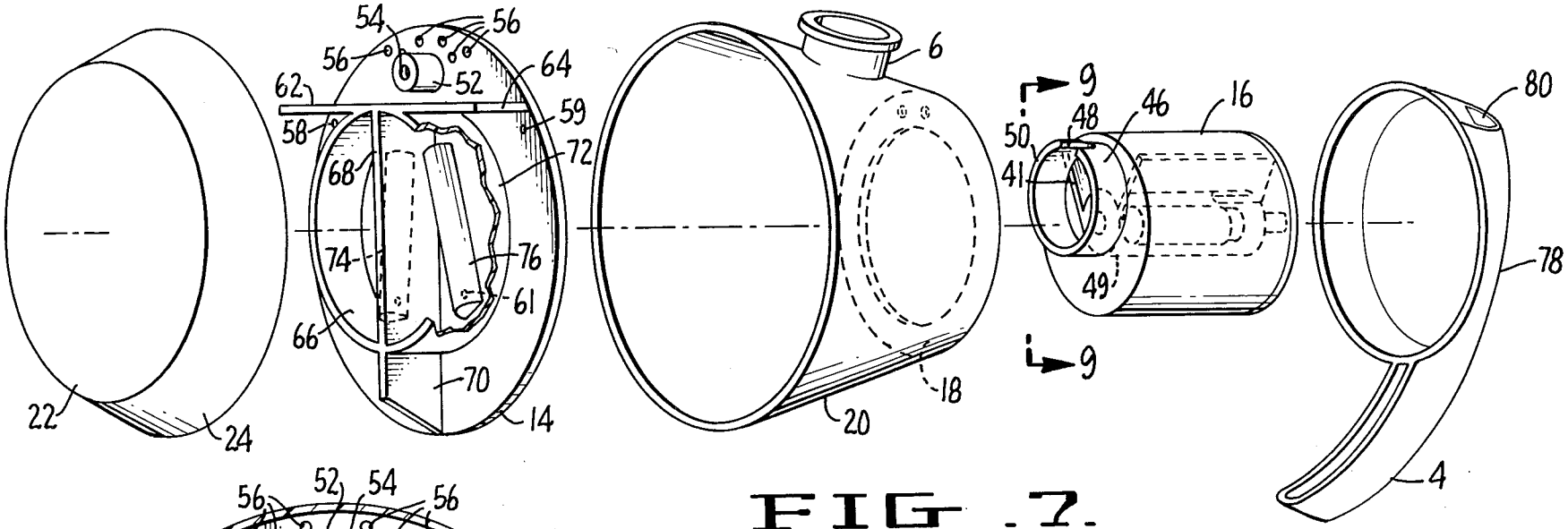
FIG. 7 is an exploded perspective view of the device of this invention.

A preferred embodiment of the toy tea kettle of this invention is illustrated in the exploded view of FIG. 7 and in the sectional views of FIGS. 1 through 6. The tea kettle comprises generally a body 2 having a handle 4 attached thereto and a filling and emptying spout 6 projecting outwardly of the filling aperture in the front side of the body. The body 2 of the tea kettle includes a primary reservoir 8, a lower reservoir 10 disposed generally below the primary reservoir in FIG. 1, and an upper reservoir 12 projecting within and spaced above the lowermost portion of the primary reservoir 8.

Figure 1:
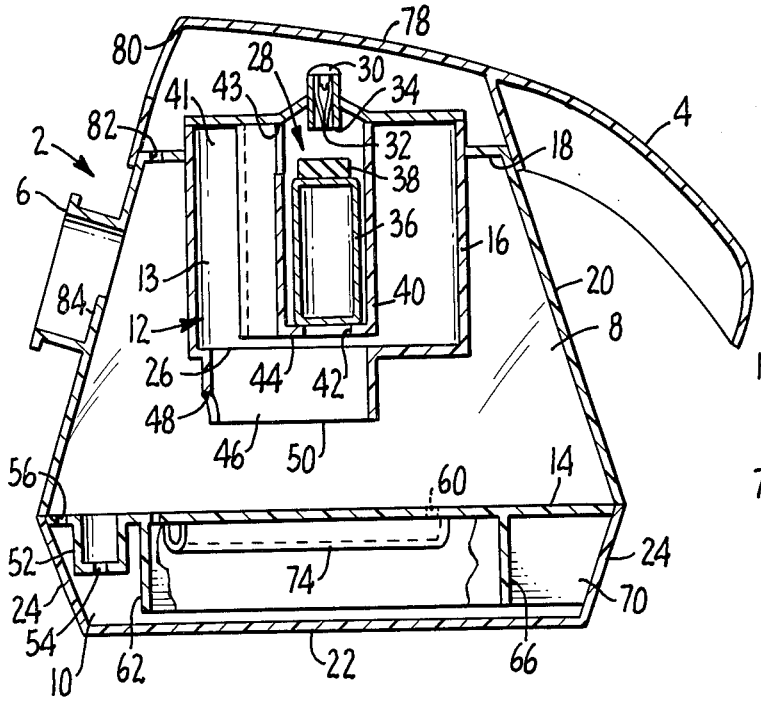
FIG. 1 is a side sectional view taken through the center of the device of this invention illustrating the device in its empty condition and an upright orientation.

With reference to both FIGS. 1 and 7, it may be seen that the primary reservoir 8 is defined by a wall member 14 on the bottom, the combination of the upper reservoir housing 16 and primary reservoir top panel 18 on the top and a side element 20, suitably of a frusto-conical shape extending between the wall member 14 and the upper wall 18, all preferably molded of a suitable rigid synthetic resin. The lower chamber 10 is defined by the wall member 14 on the top, which forms a common wall between the primary and lower reservoirs, by the body bottom panel 22 on the bottom and by the short body side 24 extending between the wall member 14 and the bottom member 22. Suitably, the bottom member 22 and the relatively short, preferably frusto-conical sides 24 of the lower reservoir may be molded as a single unit of a suitable rigid synthetic resin, preferably opague.

The upper reservoir housing 16 includes within not only the upper reservoir 12, which communicates with primary reservoir 8 through opening 26, but also the various means for producing the sound simulating the sound of steam escaping from the tea kettle. The apparatus involved in producing that sound includes a valve, generally indicated by reference numeral 28 and which communicates with both the upper reservoir 12 and the air surrounding the tea kettle, and a whistle 30 communicating with the valve 28 such that any air flowing through the valve into the upper reservoir must flow through the whistle 30 and thus produce a whistling sound. The functional components of the valve 28, illustrated best in FIG. 1, include the valve aperture 32 which is surrounded by the valve body 34, which in turn forms a part of the uppermost portion of the upper reservoir housing. Engageable with the aperture 32 and valve body 34, in a manner to be described below, is valve float member 36 having a sealing element 38, suitably of a resilient synthetic resin, extending across the top of the float member. The float member 36 is restrained by guide tube 40 to move in a direction generally parallel to the axis of the primary reservoir 8. The float member 36 within the guide tube 40 may move between an uppermost position sealingly engaging the portion of the valve body 34, or upper reservoir top, which surrounds the aperture 32 and thus closes the valve 28, and lower positions out of engagement with the valve body 34. The bottom of the tubular guide 40 includes an aperture 42 having a lip 44 surrounding that aperture and preventing the float member 36 from falling below a position engaging the lip 44. A pair of guide tube wall members 41 extend between the sides of the guide tube 40 and the adjacent sides of the upper reservoir housing 16, thus defining a generally sector-shaped forward portion of the upper reservoir 12 which is separated by those walls 41 and guide tube 40 from the rear portion or the remainder of the upper reservoir 12, for purposes to be described below. Additionally, in the uppermost portion of the guide tube 40 an aperture 43 is provided communicating between the interior of the guide tube 40 and that forward portion of the upper reservoir 12.

Extending downwardly from the aperture 26 in the upper reservoir 12 is a collar 46, suitably molded integrally with the upper reservoir housing 16. In the lower surface 50 of this collar 46 is provided a notch 48 extending upwardly toward the upper reservoir 12, for purposes to be described below.

Figure 8:
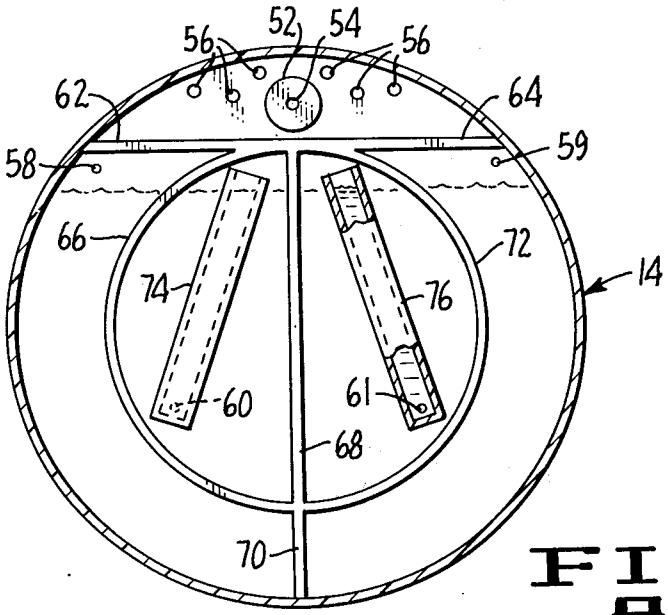
FIG. 8 is a bottom sectional view of the device of FIG. 2 taken along line 8—8.

In lower reservoir 10 the functional features are largely defined by the structure associated with common wall member 14 and best illustrated in FIGS. 1, 7 and 8. These structural features include the provision of a depressed sump 52 projecting into the lower reservoir 10 and including in its lowermost portion an aperture 54 of a predetermined size for controlling the flow of a liquid, as will be described further below. Also extending through the wall member 14 are venting apertures 56 adjacent the sump 52 and additional venting apertures 58, 59, 60, and 61 spaced further from the sump and also extending through the wall member 14. This lower reservoir 10 is further divided into a plurality of chambers by chamber wall members 62, 64, 66, 68, 70, and 72, which extend part-way from the common wall member 14 toward the bottom panel 22, as illustrated in FIG. 1. While venting apertures 56 are all located within the chamber included between the side wall 24 and the wall members 62 and 64, each of the other venting apertures 58, 59, 60, and 61 preferably are each located within their own respective separate chambers, defined by various combinations of the walls 24, 62, 64, 66, 68, 70, and 72. While the apertures 56, 58 and 59, which are proximal the front of the tea kettle, open directly into their respective chambers, the vent apertures 60 and 61 which are distal the front of the tea kettle are each provided with a tube, 74 and 76, respectively, which extends generally parallel adjacent the wall member 14 toward the front of the tea kettle. Each of these tubes 74 and 76 is closed at the end adjacent its respective venting aperture 60 or 61 and is open at the opposite end, again for purposes to be described below.

Covering the top of both the primary reservoir 8 and the upper reservoir housing 16 is a top housing 78 which covers and completely surrounds the uppermost portion of the upper reservoir housing 16. This upper housing 78 may suitably be formed of a synthetic resin and may be made as a unitary item incorporating handle 4 within the same molding. The top housing 78 extends over the top of the whistle 30 and includes an aperture 80 allowing the interior of the top housing 78 to communicate with the outside air surrounding the tea kettle. Also enclosed by this housing 78 is desirably at least one liquid return passage 82 extending between the area enclosed by the upper housing and the interior of primary reservoir 8, so that any liquid that may spill into the upper housing 78 may be returned to the primary reservoir 8 through such aperture 82.

Figure 2:
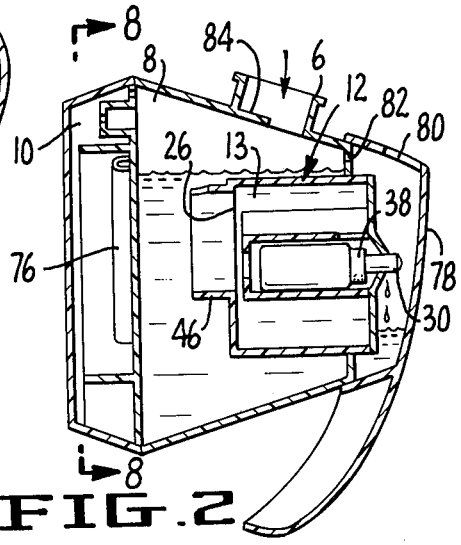
FIG. 2 is a side sectional view of the device of FIG. 1, on a reduced scale, illustrating the device in its filling orientation and its filled condition.

The manner of use and simulation of the boiling action of the toy tea kettle is best illustrated in the sequential FIGS. 2 through 6. In FIG. 2 the tea kettle is illustrated with the front portion and thus the spout 6 in an upward facing orientation for filling the primary reservoir 8 with a liquid, suitably water, through that spout. As the liquid fills the primary chamber 8 it also flows through collar 46 and aperture 26 to fill upper reservoir 12 prior to the seating of float member sealing element 38 against the aperture 32 of the valve 28, it is possible that some of the water or other liquid from within the upper reservoir may leak out the valve and whistle 30 into the volume surrounded by the upper housing 78. This liquid is held between the uppermost portion of the primary and upper reservoirs and the upper housing 78 as long as the kettle is maintained in the upward facing filling position of FIG. 2. In this filling position the function of the vent aperture tubes 74 and 76 becomes apparent. If those tubes were absent, the water filling the primary reservoir 8 would flow through the venting apertures 60 and 61, thus allowing the initially air-filled lower reservoir 10 to fill with water to substantially the same level as that in the primary reservoir 8, a condition that is undesirable for reasons to be discussed below. As illustrated in FIG. 8, the provision of such tubes 74 and 76 requires any liquid flowing from the primary reservoir 8 through the venting apertures 60 and 61 to remain in and fill that tube until the primary reservoir has been filled at least to a level even with the opened front end of those tubes 74 and 76, thus preventing any of the water from leaking into the lower reservoir up to that point. If the filling of the primary reservoir 8 is then terminated, no water will leak into the lower reservoir during that filling operation. Additionally, if the overflow return passage 82 between the primary reservoir and the upper housing 78, and the upper housing opening 80 is suitably located, any over-filling of the primary reservoir will cause the water to flow out the return passage 82, first filling up the upper housing 78 and then spilling out through opening 80, without causing leakage of water into the lower reservoir 10.

When the tea kettle is then returned to its normal upright position (FIG. 3) the water with which the primary reservoir is filled is retained within the primary reservoir by filling aperture lip 84 extending across and partially blocking the aperture communicating with the spout 6. The tea kettle preferably is sized such that the volume defined within the primary reservoir by the retention of water by this lip 84 is substantially the same as the maximum volume of water with which the kettle may be filled in the orientation of FIG. 2. When the tea kettle is returned to this upright position of FIG. 3, any water held within the upper reservoir 78 may then return to the primary reservoir 8 through the return passage 82, thus preventing spillage of that upper housing water. Also, as the tea kettle is returned to this orientation the buoyancy of the float member 36 brings the resilient sealing member 38 into sealing engagement with the aperture 32 and bottom 34 of the valve 28, thus preventing any air from entering the upper portion of the upper reservoir 12. With the valve 28 closed and air thus, at least momentarily, excluded from the upper reservoir 12, and the only communication between the upper reservoir 12 and the primary reservoir 8 being submerged under the water contained within the tea kettle, the water in the upper reservoir is thus held or suspended within the upper reservoir in the configuration of FIG. 3.

Figure 3:
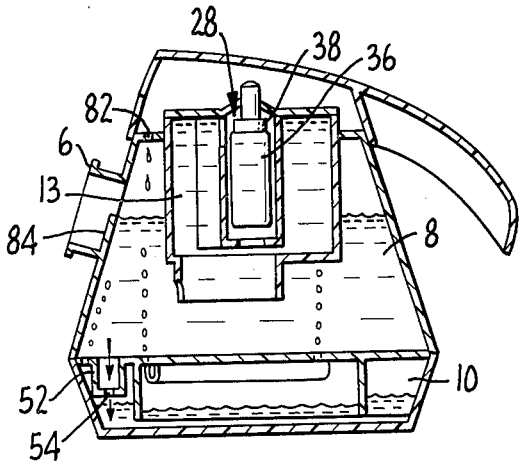
FIG. 3 is a side sectional view of the device of FIG. 1 in its filled condition and in an upright orientation.

Since water was excluded from the lower reservoir 10 during the filling process (except for the small amount in the tubes 74 and 76) this lower reservoir and each of its chambers are substantially filled with air upon the return of the kettle to the upright position of FIG. 3. In this position, however, the weight of the water will tend to urge it to flow through the apertures from the primary reservoir 8 into the lower reservoir 10. Since the aperture 54 at the lowermost point of the sump 52 is substantially below any of the other apertures, the water will tend to drip or flow through that aperture 54 into the lower reservoir 10. This aperture 54 is of a predetermined size to control the flow of water into the lower reservoir and limit such flow to a preferred slow rate. As the water flows into the lower reservoir 10, it can spread throughout the entire lower reservoir, since the walls 62, 64, 66, 68, 70, and 72 forming the separate chambers extend only part-way to the bottom of that lower reservoir. In order for such water to flow into the reservoir, as indicated in FIG. 3, it is necessary that the air initially held in that reservoir be displaced. This is achieved by the water flowing into the lower reservoir through flow control aperture 54 forcing the air in bubbles out the various venting apertures 56, 58, 59, 60, and 61, in the manner illustrated in FIG. 3. It is this escape of air in the form of bubbles from a plurality of positions around the tea kettle, which may be observed through the transparent sides of the primary reservoir 8, that simulates the appearance of water boiling within the tea kettle.

Figure 4:
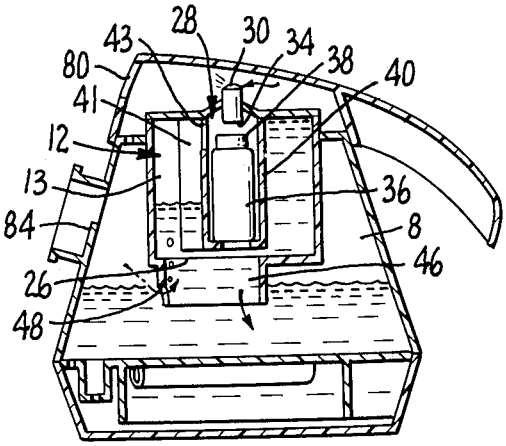
FIG. 4 is a side sectional view of the device of FIG. 1 illustrating it in the condition in which the upper reservoir has just initiated draining.

As the water from the primary reservoir continues to flow through flow control aperture 54, the water level in primary reservoir 8 continues necessarily to drop from that illustrated in FIG. 3 toward that illustrated in FIG. 4. As long as the water level is sufficiently high to prevent the introduction of air into the collar 46 and thus into upper reservoir 12, the water in that upper reservoir 12 will remain suspended due to the vacuum, or more accurately, the low pressure area existing between the uppermost portion of that water and interior of the uppermost portion of the upper reservoir 12. However, upon the water in the primary reservoir falling to a predetermined level, that level in which air may be introduced into the upper reservoir, the conditions in the upper reservoir change dramatically.

Figure 9:
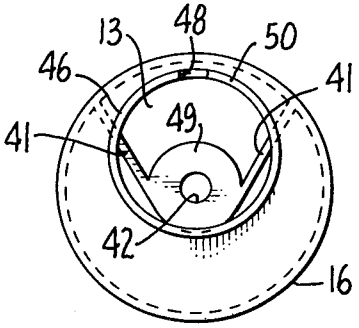
FIG. 9 is a bottom sectional view of the device of FIG. 7, taken along line 9—9.

When the declining water level reaches that predetermined level, which is defined by the lower surface 50 of the collar 46, or more specifically in this embodiment, by the level of the uppermost portion of the notch 48, air from the primary reservoir may flow into the collar 46, through the aperture 26 and into upper reservoir 12. This notch 48 preferably is located at the front of the collar 46 so that the air initially entering the upper reservoir 12 enters into the forward part 13 of that reservoir, the upper portion of which is separated from the remainder of the reservoir by the float chamber wall members 41 extending between the sides of the guide tube 40 and the sides of the upper reservoir housing 16, as is most clearly illustrated in FIGS. 7 and 9. The aperture 43 in the front of the top portion of guide tube 40 permits those first bubbles of air through the notch 48 to pass not only to the uppermost portion of the forward portion 13 of the upper reservoir but also into the guide tube 40, thus allowing some of the water to be displaced therefrom. The float member 36 is provided with a predetermined buoyancy such that the total buoyancy of that float member 36 when completely submerged in the water or other liquid used in the tea kettle is only slightly greater than the weight of the float member and its resilient sealing element 38. Thus, as long as the upper reservoir 12 and thus the guide tube 40 are maintained substantially completely filled with the water, the buoyancy of the float member 36 will maintain the sealing element 38 in sealing engagement with the bottom 34 of the valve body, thus preventing the entry of any outside air through that valve. However, when the water level in the primary reservoir falls below the predetermined level such that air may enter around the collar 46 or notch 48 into the upper reservoir 12, as in FIG. 4, the liquid level in the upper reservoir is lowered, thus allowing gravity to lower the valve float member 36 from its uppermost position and thus to break the sealing engagement between the sealing member 38 and the lower surface 34 of the valve body, opening the valve 28. When the valve 28 is thus opened, outside air from that surrounding the tea kettle may enter through the upper housing aperture 80 and then through open valve 28 into the upper reservoir, thus breaking the suspension of the water in the upper reservoir and allowing it to flow rapidly out of that upper reservoir through the aperture 26 into the primary reservoir 8, as illustrated in FIGS. 4 and 5. This rapid flow of water out of the upper reservoir thus brings the rapid introduction of air into the upper reservoir through the valve 28, with the rushing of the air simulating the sound of steam escaping from the tea kettle. Since the air flowing through the valve 28 necessarily flows also through the whistle 30 communicating with that valve, this rapid introduction of air into the upper reservoir provides for a whistling effect simulating that of the popular whistling tea kettles when steam is escaping from them.

Once the upper chamber is opened for the introduction of air through the valve 28, the water may continue flowing out of the upper reservoir 12 even after that draining upper reservoir water has raised the level of water in the primary reservoir 8 back above the level of the notch 48, as illustrated in FIG. 5. Additionally, since the guide tube walls 41 and the guide tube 40 initially restrict the air entering the upper reservoir 12 to flow only into the upper portions of the guide tube 40 and the forward sector-like portion 13 of the upper reservoir 12, the water in the rear portion of the upper reservoir 12, behind the float chamber walls 41, will remain suspended and not drain until air is allowed to enter that rear portion by the water level in the forward portion dropping below the lowermost portion of the walls 41 and guide tube 40, as illustrated in FIG. 5. Upon the lowering of the water level in the forward portion 13 of the upper reservoir to that point, the rear portion of the upper reservoir will begin draining into the primary reservoir 8 as air is drawn in through the valve 28 and whistle 30 and under the guide tube 40 and walls 41 to replace the falling water, as illustrated by the arrows in FIG. 5. Since the air drawn in by the falling water will continue the whistling as long as the upper reservoir 12 continues its rapid draining into the main reservoir 8, the division of the upper reservoir 12 by the inclusion of the guide tube walls 41 may serve to prolong slightly the draining of the upper reservoir 12 and thus the whistling operation. Obviously, the device of this invention would also be operable without those walls 41.

The liquid capacity of the lower reservoir 10 preferably is made slightly greater than the volume of liquid necessary for transfer from the primary reservoir 8 into the lower reservoir 10. Thus, the lower reservoir 10 will be nearly filled with the liquid at the time that the upper reservoir 12 drains and produces the whistling sound. Accordingly, at the time of that draining and the simulation of the sound of steam escaping, the air initially filling the lower reservoir 10 has been displaced, thus effectively terminating the visual simulation of the boiling. At this point a child using the tea kettle of this invention would generally pour the water out of the tea kettle, thus emptying both the primary reservoir 8 through the spout 6 and also emptying the lower reservoir 10 through the apertures 54 and 56 and thence out the spout 6, as illustrated in FIG. 6. At this point the tea kettle may be refilled for repetition of the simulation of the boiling of water and escape of steam, all as described above.

While a particularly preferred embodiment of the amusement device of this invention, suitably molded from a generally rigid synthetic resin, has been described and illustrated in detail, it is to be understood that this description is merely illustrative of the principles of the invention and in no way limits the scope thereof. Accordingly, since numerous variations and modifications, incorporating the same or other suitable materials and all being within the scope of this invention, will readily occur to those skilled in the art, the scope of this invention is to be limited solely by the claims appended hereto.

What is claimed is:

1. An amusement device in the form of a tea kettle for simulating, without heat, the boiling of water therewithin and the sound of the escape of steam therefrom, such device comprising a body having a primary reservoir;

a lower reservoir disposed generally below said primary reservoir when said device is in a generally upright orientation;

a filling aperture extending through a side of said primary reservoir and through which liquid is introduced into said primary reservoir from outside the device;

liquid flow control and venting means joining said primary and lower reservoirs and providing for the controlled flow of liquid and air between said primary and lower reservoirs and for maintaining air within said lower reservoir while liquid is being introduced into said primary reservoir; and sound producing means comprising an upper reservoir spaced above the lowermost portion of and communicating with said primary reservoir, means for introducing an amount of said liquid into said upper reservoir when said device is being filled with said liquid; and liquid holding means for holding said liquid introduced into said upper reservoir within said upper reservoir as long as the liquid level within said primary reservoir is maintained at not less than a predetermined level, and then, when a sufficient quantity of said liquid has flowed from said primary reservoir into said lower reservoir to lower said primary reservoir liquid level below said predetermined level, for providing for both the rapid flow of liquid from said upper reservoir into said primary reservoir and the rapid introduction of air into said upper reservoir to replace said liquid flowing therefrom and to produce a sound simulating the sound of steam escaping from a tea kettle.

2. The device of claim 1 wherein said primary reservoir and said lower reservoir are separated by a common wall member, and wherein said liquid flow control and venting means comprise a plurality of apertures extending through said common wall member, whereby the liquid in the primary reservoir may flow from the primary reservoir through at least one of the liquid flow control apertures and into the lower reservoir at a controlled rate while air escapes from said lower reservoir into said primary reservoir through at least one of the venting apertures.

3. An amusement device in the form of a tea kettle for simulating, without heat, the boiling of water therewithin and the sound of the escape of steam therefrom, such device comprising a body having a primary reservoir, a lower reservoir disposed generally below said primary reservoir when said device is in a generally upright orientation, means for introducing a predetermined amount of liquid into said device body, whereby the device may intially be filled with a predetermined amount of liquid and air, liquid flow control and venting means joining said primary and lower reservoirs and providing for the controlled flow of liquid and air between said lower and primary reservoirs and for selectively draining said liquid from said lower reservoir into said primary reservoir, whereby, upon the selective draining of the lower reservoir, the lower reservoir may be substantially filled with air, and sound producing means comprising an upper reservoir spaced above the lowermost portion of and communicating with said primary reservoir, means for introducing an amount of said liquid into said upper reservoir when said primary reservoir is being filled with said liquid; and liquid holding means for holding said liquid introduced into said upper reservoir within said upper reservoir when the device is placed in its generally upright orientation as long as the liquid level within said primary reservoir is maintained at not less than a predetermined level, and then, when a sufficient quantity of said liquid has flowed from said primary reservoir into said lower reservoir to lower said primary reservoir liquid level below said predetermined level, for providing for both the rapid flow of liquid from said upper reservoir into said primary reservoir and the rapid introduction of air into said upper reservoir to replace said liquid flowing therefrom and to produce a sound simulating the sound of steam escaping from a tea kettle.

4. The device of claim 3 wherein said upper reservoir liquid introducing means comprises an aperture in the lowermost portion of said upper reservoir, whereby the liquid introduced into the upper reservoir comprises a portion of the liquid introduced into the primary reservoir.

5. The device of claim 4 wherein said upper reservoir liquid holding means comprises a valve which communicates with said upper reservoir and with the air above said upper reservoir and which is maintained closed by forces exerted by said upper reservoir liquid as long as said primary reservoir liquid level is maintained above said predetermined level and which is opened for the inflow of air therethrough when said primary reservoir liquid level is below said predetermined level, whereby, while the valve is maintained closed and the device is oriented generally upright, the upper reservoir liquid is held suspended within the upper reservoir by the low pressure between the suspended liquid and the uppermost portion of the upper reservoir and then, when the valve is opened, air from that above the upper reservoir is allowed to rush in and thus break the suspension holding the liquid in the upper reservoir.

6. The device of claim 5 further comprising whistle means communicating with said valve such that air introduced into said upper reservoir through said valve is directed through said whistle means to produce a whistling sound therethrough, whereby the whistling sound of steam escaping from a tea kettle may be simulated.

7. The device of claim 5 wherein said valve comprises, in combination, a valve aperture communicating with said upper reservoir uppermost portion and with the air above said upper reservoir, and a float member of predetermined bouyancy movable between an uppermost position sealingly engaging the portion of said upper reservoir surrounding said valve aperture and thus maintaining said valve closed when said float member is being supported by a predetermined level of liquid within said upper reservoir and a lower position out of engagement with said upper reservoir valve surrounding portion and thus opening said valve.

8. The device of claim 7 wherein said valve float member bouyancy is such that said float member is maintained in said valve-closing, sealingly engaging uppermost position only as long as said upper chamber is maintained substantially completely filled with said liquid, and wherein said primary reservoir predetermined liquid level is defined as that level which permits introduction of air from said primary reservoir into said upper reservoir liquid introducing aperture, thereby lowering the level of liquid in said upper reservoir, whereby, when the primary reservoir liquid level falls to that predetermined level, the introduction of air from the primary reservoir into the upper reservoir serves to lower the upper reservoir liquid level and thus allow gravity to lower the valve float member from its uppermost position sealingly engaging the upper reservoir portion surrounding the valve aperture to said lower position and thus open the valve.

9. The device of claim 8 wherein said upper reservoir liquid holding means further comprises a collar surrounding said upper reservoir liquid introducing aperture and extending within said primary reservoir a predetermined distance from said upper reservoir lowermost portion toward said common wall member, with the lower surface of said collar generally facing said common wall member, whereby, when the device is sitting upright, a portion of the collar lower surface defines the primary reservoir predetermined liquid level.

10. The device of claim 9 wherein said collar includes a notch in said collar lower surface extending upwardly toward said upper reservoir, whereby, when the device is sitting upright, the level of the uppermost portion of the notch defines the primary reservoir predetermined liquid level with the size of the notch at least partially controlling the rate of inflow of air from the primary reservoir into the upper reservoir.

11. The device of claim 9 wherein said valve further comprises guide means for guiding said valve float member between said uppermost position and said lower position.

12. The device of claim 11 wherein said valve guide means comprises a tubular member extending from said upper reservoir uppermost portion at least part way toward said upper reservoir lowermost portion and including adjacent its uppermost end an aperture providing for the passage of fluid between the interior of said tubular member and the portion of said upper reservoir adjacent said tubular member uppermost end, whereby air introduced into the upper reservoir may flow into the uppermost portion of the tubular member and lower the level of upper reservoir liquid within that tubular member and thus allow the valve float member to fall to a valve opening position.

13. The device of claim 5 further comprising overflow return means for catching and returning to said primary chamber any liquid overflowing from said primary reservoir, through said upper reservoir and out said valve during the filling of said primary reservoir.

14. The device of claim 13 wherein said overflow return means comprises a housing covering the portion of said valve which communicates with the air above said upper reservoir and extending toward the front of said body, and a liquid return passage extending between said housing and the interior of said primary reservoir, whereby any liquid overflowing out the valve during filling of the device may be caught within the housing and returned to the primary reservoir through the liquid return passage.

15. The device of claim 2 wherein said filling aperture is located at the front of said body and wherein at least one said venting aperture through said common wall member is located proximal said body front and at least one other said venting aperture is located distal said body front.

16. The device of claim 3 wherein at least a portion of the sides of said primary reservoir is formed of a material that is at least partially transparent.

17. The device of claim 15 further comprising, for each said distal venting aperture, a venting aperture tube communicating with said venting aperture and extending from said distal aperture generally toward said body front, said venting aperture tube being generally parallel and adjacent said common wall member and having its end adjacent said venting aperture closed and its opposite end open, whereby, when the device is being filled with the front facing upwardly, the venting aperture tube will tend to require any liquid flowing from the primary reservoir through that distal venting aperture to remain in that tube until the primary reservoir is filled at least to a level even with the open end of that tube.

18. The device of claim 3 wherein said primary reservoir and said lower reservoir are separated by a common wall member, and wherein said liquid flow control and venting means comprise a plurality of apertures extending through said common wall member, whereby the liquid in the primary reservoir may flow from the primary reservoir through at least one of the liquid flow control apertures and into the lower reservoir at a controlled rate while air escapes from said lower reservoir into said primary reservoir through at least one of the venting apertures.

19. The device of claim 18 wherein said common wall member includes a sump depression projecting into said lower reservoir from said primary reservoir, and wherein at least one said liquid flow control aperture is located in said sump depression, whereby the liquid from the primary reservoir may pass through the sump depression aperture and cause air in the lower reservoir to be displaced upwardly through said venting aperture.

20. The device of claim 18 wherein at least one said venting aperture is located proximal the front of said device body and at least one other said venting aperture is located distal said body front.

21. The device of claim 20 wherein said lower reservoir is defined by said common wall member on the top, by a body bottom member on the bottom and by the body sides extending between said common wall member and said bottom member, and wherein said lower reservoir is divided into a plurality of chambers, each open at the bottom, by chamber wall members extending part-way from said common wall member toward said body bottom member, and wherein at least one said venting aperture is provided within each said chamber, whereby the air contained within each of the chambers will tend to be displaced into the primary reservoir through the venting aperture provided within that chamber as liquid from the primary reservoir flows into the lower reservoir through the liquid flow control aperture.

* * * * *